US009863073B2

(12) United States Patent
Stralin et al.

(10) Patent No.: US 9,863,073 B2
(45) Date of Patent: Jan. 9, 2018

(54) HYDROENTANGLED SPLIT-FIBRE NONWOVEN MATERIAL

(71) Applicant: SCA HYGIENE PRODUCTS AB, Gothenburg (SE)

(72) Inventors: Anders Stralin, Torslanda (SE); Hannu Ahoniemi, Landvetter (SE); Lars Fingal, Gothenburg (SE); Mikael Strandqvist, Lindome (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 195 days.

(21) Appl. No.: 14/630,741

(22) Filed: Feb. 25, 2015

(65) Prior Publication Data

US 2015/0218742 A1 Aug. 6, 2015

Related U.S. Application Data

(63) Continuation of application No. 11/643,902, filed on Dec. 22, 2006, now abandoned, which is a (Continued)

(51) Int. Cl.
*D04H 5/03* (2012.01)
*D04H 1/4382* (2012.01)
(Continued)

(52) U.S. Cl.
CPC ..... *D04H 5/03* (2013.01); *D04H 1/4382* (2013.01); *D04H 1/4391* (2013.01); (Continued)

(58) Field of Classification Search
CPC ..... D04H 5/03; D04H 18/04; D04H 1/492; D04H 3/11; D04H 1/465; D04H 1/495; (Continued)

(56) References Cited

U.S. PATENT DOCUMENTS 4,190,695 A 2/1980 Niederhauser
4,775,579 A * 10/1988 Hagy ..... B32B 5/04 28/104
(Continued)

FOREIGN PATENT DOCUMENTS

EP 0 540 041 5/1993
EP 1 070 778 1/2001
(Continued)

OTHER PUBLICATIONS

Notice of Opposition from European counterpart application No. 04749094.1 (U.S. Pat. No. 1,766,121) dated Jan. 28, 2013 (13 pages).
(Continued)

*Primary Examiner* — Amy Vanatta
(74) *Attorney, Agent, or Firm* — Drinker Biddle & Reath LLP

(57) ABSTRACT

A hydroentangled integrated composite nonwoven material, includes a mixture of randomized continuous filaments, splittable shortcut staple fibers, and optionally non-splittable staple fibers. The splittable fibers should be 3-16 mm long bicomponent fibers. Preferably there should be no thermal bonding points between the filaments. The nonwoven material has improved textile feeling and reduced two-sidedness. The continuous filaments should preferably be spunlaid filaments. Some of the staple fibers can be colored. A process of producing such a nonwoven material is disclosed.

13 Claims, 3 Drawing Sheets

Related U.S. Application Data continuation of application No. PCT/SE2004/001056, filed on Jun. 29, 2004.

(51) Int. Cl.

| | |
|---|---|
| ***D04H 1/4391*** | (2012.01) |
| ***D04H 13/00*** | (2006.01) |
| ***D04H 1/492*** | (2012.01) |
| ***D04H 3/033*** | (2012.01) |
| ***D04H 3/11*** | (2012.01) |

(52) U.S. Cl.

CPC ..... *D04H 1/492* (2013.01); *D04H 3/033* (2013.01); *D04H 3/11* (2013.01); *D04H 13/00* (2013.01); *D10B 2321/021* (2013.01); *D10B 2321/022* (2013.01); *D10B 2331/02* (2013.01); *Y10T 442/608* (2015.04); *Y10T 442/611* (2015.04); *Y10T 442/637* (2015.04); *Y10T 442/689* (2015.04); *Y10T 442/697* (2015.04)

(58) Field of Classification Search

CPC .... D04H 1/498; D04H 1/4382; D04H 1/4391; D04H 3/033; Y10T 442/689

USPC ..... 28/104, 105, 167

See application file for complete search history.

(56) References Cited

U.S. PATENT DOCUMENTS

| | | | | |
|---|---|---|---|---|
| 4,808,467 | A | 2/1989 | Suskind et al. | |
| 5,144,729 | A | 9/1992 | Austin et al. | |
| 5,290,628 | A * | 3/1994 | Lim | B32B 5/26 2/272 |
| 5,298,315 | A | 3/1994 | Fukui et al. | |
| 5,328,759 | A * | 7/1994 | McCormack | A61F 13/15658 156/148 |
| 5,935,883 | A * | 8/1999 | Pike | D01D 5/0985 428/397 |
| 6,163,943 | A | 12/2000 | Johansson et al. | |
| 6,291,105 | B1 | 9/2001 | Yamamoto et al. | |
| 6,495,255 | B2 | 12/2002 | Tsutsui et al. | |
| 6,550,115 | B1 * | 4/2003 | Skoog | B32B 5/26 28/104 |
| 7,194,788 | B2 | 3/2007 | Clark et al. | |
| 2004/0010895 | A1 | 1/2004 | Vonfeldt et al. | |
| 2004/0121689 | A1 | 6/2004 | Anderson et al. | |
| 2009/0176063 | A1 * | 7/2009 | Schubert | B32B 5/022 428/172 |

FOREIGN PATENT DOCUMENTS

| | | |
|---|---|---|
| EP | 1 314 808 | 5/2003 |
| WO | WO-00/20178-AI | 4/2000 |
| WO | WO-01/88247 A1 | 11/2001 |
| WO | WO 02/38846 | 5/2002 |
| WO | WO-03/093543 A1 | 11/2003 |

OTHER PUBLICATIONS

Annual Book of ASTM Standards: Section 7 vol. 07.01. ASTM International. West Conshohocken, PA. pp. 1, 9, 51.

Saville, B. P. Physical Testing of Textiles, Woodhead Publishing Limited, Cambridge, England. pp. 132-138.

Dahiya, Atul, M. G. Kamath, Raghavendra R. Hedge, Ramaiah Kotra, and Haoming Rong. "Melt Blown Technology." University of Tennessee Knoxville. Last Updated on Apr. 2004. Web. Accessed on Aug. 23, 2012. <http://web.utk.edu/—mse/Textiles/Melt%20Blown%20Technology.htm>.

Grounds of Appeal from European counterpart application No. 04749094.1 (Patent No. EP 1 766 121) dated Jul. 2, 2014 (11 pages).

International Search Report dated Jan. 21, 2005 issued in corresponding International application No. PCT/SE2004/001056 (filed Jun. 29, 2004) (5 pages).

* cited by examiner

HYDROENTANGLED SPLIT-FIBRE NONWOVEN MATERIAL

CROSS REFERENCE TO RELATED APPLICATION

This application is a continuation of international application PCT/SE2004/001056, which was filed on 29 Jun. 2004, designated the United States of America, and was published in English as international publication WO 2006/001739.

FIELD OF THE INVENTION

The present invention refers to a hydroentangled integrated composite nonwoven material, comprising a mixture of randomized continuous filaments, splittable shortcut staple fibres. The present invention further refers to a process for forming a hydroentangled integrated composite nonwoven material, comprising the steps of:

- forming a web of randomized continuous filaments on a forming fabric,
- providing an aqueous fibre dispersion comprising splittable shortcut staple fibres and optional non-splittable staple fibres,
- wetlaying the aqueous fibre dispersion on said web of said continuous filaments, thus forming a fibrous web comprising said continuous filaments, splittable shortcut staple fibres and optional non-splittable staple fibres,
- and subsequently hydroentangling the fibrous web to form a hydroentangled nonwoven material.

BACKGROUND OF THE INVENTION

Absorbing nonwoven materials are often used for wiping spills and leakages of all kinds in industrial, service, office and home locations. The basic synthetic plastic components normally are hydrophobic and will absorb oil, fat and grease, and also to some degree water by capillary force. To reach a higher water absorption level, cellulosic pulp can be added. There are many demands put on nonwoven materials made for wiping purposes. An ideal wiper should be strong, absorbent, abrasion resistant and exhibit low linting. To replace textile wipers, which is still a major part of the market, they should further be soft and have a textile touch.

Hydroentangling or spunlacing is a technique introduced during the 1970'ies, see e.g. CA patent no. 841 938. The method involves forming a fibre web which is either drylaid or wetlaid, after which the fibres are entangled by means of very fine water jets under high pressure. Several rows of water jets are directed against the fibre web which is supported by a movable fabric. The entangled fibre web is then dried. The fibres that are used in the material can be synthetic or regenerated staple fibres, e.g. polyester, polyamide, polypropylene, rayon or the like, pulp fibres or mixtures of pulp fibres and staple fibres. Spunlace materials can be produced with high quality to a reasonable cost and have a high absorption capacity. They can e.g. be used as wiping material for household or industrial use, as disposable materials in medical care and for hygiene purposes etc.

From U.S. Pat. No. 6,706,652 it is known to make a nonwoven cleaning cloth of continuous multicomponent filaments which are laid down and optionally pre-bonded. The filaments are then split and bonded, preferably by high-pressure fluid jets to form a cleaning cloth with a very uniform thickness and isotropic fibre distribution. The cloth has no tendency to delaminate.

Such a nonwoven consisting only of filaments will normally be rather flat and have a low bulk, especially for lower basis weights.

From EP-A-0 308 320 it is known to bring together a prebonded web of continuous filaments with a separately prebonded wetlaid fibrous web containing pulp fibres and staple fibres and hydroentangle together the separately formed webs to a laminate.

In such a laminate the fibres or filaments from one of the webs will not be integrated with filaments or fibres from the other web since the fibres or filaments already prior to the hydroentangling are bonded to each other in each separate prebonded web and only have a very limited mobility. The laminate will show a marked two-sidedness. The staple fibres used have a preferred length of 12 to 19 mm, but could be in the range from 9.5 mm to 51 mm.

In WO 2001/88247 is disclosed a method of making a nonwoven that can be three-dimensionally patterned. A web of splittable filaments or carded splittable bicomponent staple fibres is preentangled and then transferred to a patterning drum for final hydroentangling, where the splittable filaments or fibres will be split into finer fibrils which are more pliable and can adjust very well to the patterning drum, such that a material with a very pronounced three-dimensional pattern can be achieved.

One problem is clearly seen with hydroentangled materials where different fibres are to be mixed with each other—they will very often be markedly two-sided, i.e. it can clearly be discerned a difference between the side of the material facing the fabric and the side of the material facing the water jets in the entangling step. In some cases this has been used as a favourable feature, but in most cases it is seen as a disadvantage. When two separate layers are combined and fed into an entangling process, normally this process step cannot thoroughly mix the layers, but the layers will still be discernible, albeit bonded to each other. With pulp in the composite there will be a pulp-rich side and a pulp-poor side, which will result in differing properties of the two sides. Also if a filament web and a staple fibres web are mixed, there will be a side rich in staple fibres and a side rich in filaments. This is pronounced when spunlaid filaments are used as they tend to form a flat two-dimensional layer when created, which will mix poorly. Some producers have tried to first add a covering layer and entangle from one side and then turn the web around and add another covering layer and entangle from the other side, but most of the fibre-moving occurs very early in the entangling process, and this more complicated process does not fully solve the problem.

The splitting of splittable bicomponent staple fibres is normally a very energy-intensive operation, as the fibre segments before they are treated by a card need to be strong enough to hold together during the fibre bale opening and the web preparation of the fibres, otherwise the amount of 'fibres' to be handled by the card would be multiplied and the process load on the card would be too high.

Another problem when using a web consisting only of filaments in a hydroentangled nonwoven is that there will be few free fibre ends, as the filaments in principle are without ends, and only staple and pulp fibres can contribute with free ends. Especially polymer fibre ends are what will give the material a textile feeling by their softening effect. In some hydroentangled composites pulp has been added because of its water absorption capacity, which will also add a lot of fibre ends, but as the pulp fibres engage in hydrogen bonds they will not contribute to a soft textile feeling; instead they will make the resulting material feel much harsher. Thus to get a soft textile-feeling material it is important to have a high percentage of textile, i.e. synthetic, staple fibres in a hydroentangled nonwoven material.

OBJECT AND SUMMARY OF THE INVENTION

It is an object of the present invention to provide a hydroentangled integrated composite nonwoven material, comprising a mixture of randomized continuous filaments and staple fibres which has an improved textile feeling.

It is also an object of the present invention to provide a hydroentangled integrated composite nonwoven material, comprising a mixture of randomized continuous filaments and staple fibres which has a reduced two-sidedness, i.e. both sides should have appearances and properties that are similar.

This is according to the invention obtained by providing such a hydroentangled nonwoven material where the staple fibres are splittable shortcut staple fibres, the splittable shortcut staple fibres having a length of 3-16 mm, preferably 3-10 mm, and more preferably 3-7 mm.

According to an embodiment of the invention, the material has no thermal bonding points between the continuous filaments. This will ascertain an initial greater flexibility of movement of the filaments before they have been fully bonded by the hydroentangling, thus allowing the filaments and staple fibres to more fully mix into an integrated composite web.

According to an embodiment of the invention, the material also comprises non-splittable staple fibres. These non-splittable fibres could advantageously be chosen from the group of polyethylene, polypropylene, polyesters, polyamides, polylactides, rayon, and lyocell fibres and/or from the group of polyethylene-polypropylene, polypropylene-polyester, polypropylene-polyamides bicomponent fibres without ability to split.

According to an embodiment of the invention, the material comprises a mixture of 15-75%, preferably 25-60%, continuous filaments and 25-85%, preferably 40-75%, splittable shortcut staple fibres, where all percentages are calculated by weight of the total nonwoven material.

According to an embodiment of the invention, the material comprises a mixture of 15-75%, preferably 25-60%, continuous filaments, 10-60%, preferably 15-50%, splittable shortcut staple fibres, and 1-75%, preferable 1-60%, non-splittable staple fibres, where all percentages are calculated by weight of the total nonwoven material.

According to an embodiment of the invention, the continuous filaments are spunlaid filaments, preferably of the spunbond type.

According to an embodiment of the invention, the material in the continuous filaments are chosen from the group of polypropylene, polyesters and polylactides.

According to an embodiment of the invention, the continuous filaments web part of the hydroentangled nonwoven material has a basis weight of at most 40 g/m$^2$, preferably at most 30 g/m$^2$.

According to an embodiment of the invention, the splittable shortcut staple fibres are chosen from the group of polyethylene-polypropylene, polypropylene-polyester, polypropylene-polyamide bicomponent fibres with ability to split.

According to an embodiment of the invention, the splittable shortcut staple fibres are chosen from the group of banded, crescent, star or pie types of bicomponent fibres.

According to an embodiment of the invention, a part of the non-splittable staple fibres is coloured, constituting at least 3% of the total weight of the nonwoven, preferably at least 5%.

According to an embodiment of the invention, 0.1-3% of an antistatic agent has been added, calculated on the total weight of the nonwoven material.

A further object of the invention is to provide a process for producing a hydroentangled integrated composite nonwoven material, comprising the steps of:

- forming a web of randomized continuous filaments on a forming fabric,
- providing an aqueous fibre dispersion comprising splittable shortcut staple fibres and optional non-splittable staple fibres,
- wetlaying the aqueous fibre dispersion on said web of said continuous filaments, thus forming a fibrous web comprising said continuous filaments, splittable shortcut staple fibres and optional non-splittable staple fibres,
- and subsequently hydroentangling the fibrous web to form a hydroentangled nonwoven material, which material has a reduced two-sidedness, i.e. both sides should have appearances and properties that are similar, and which material also has an improved textile feeling.

This is according to the invention obtained by for the splittable shortcut staple fibres choosing splittable shortcut staple fibres having a length of 3 to 16 mm, preferably 3 to 10 mm, more preferably 3 to 7 mm, and that the major part of the splittable fibres is split during the dispersion preparation or hydroentanglement process steps.

A preferred embodiment of the inventive process is based on not applying any thermal bonding process step to the web of continuous filaments.

Other preferred embodiments of the inventive process are based upon using the fibre types, in particular weight percentages.

BRIEF DESCRIPTION OF THE DRAWINGS

The invention will be closer described below with reference to some embodiments shown in the accompanying drawings.

DETAILED DESCRIPTION OF THE PREFERRED EMBODIMENTS

Figure 1:
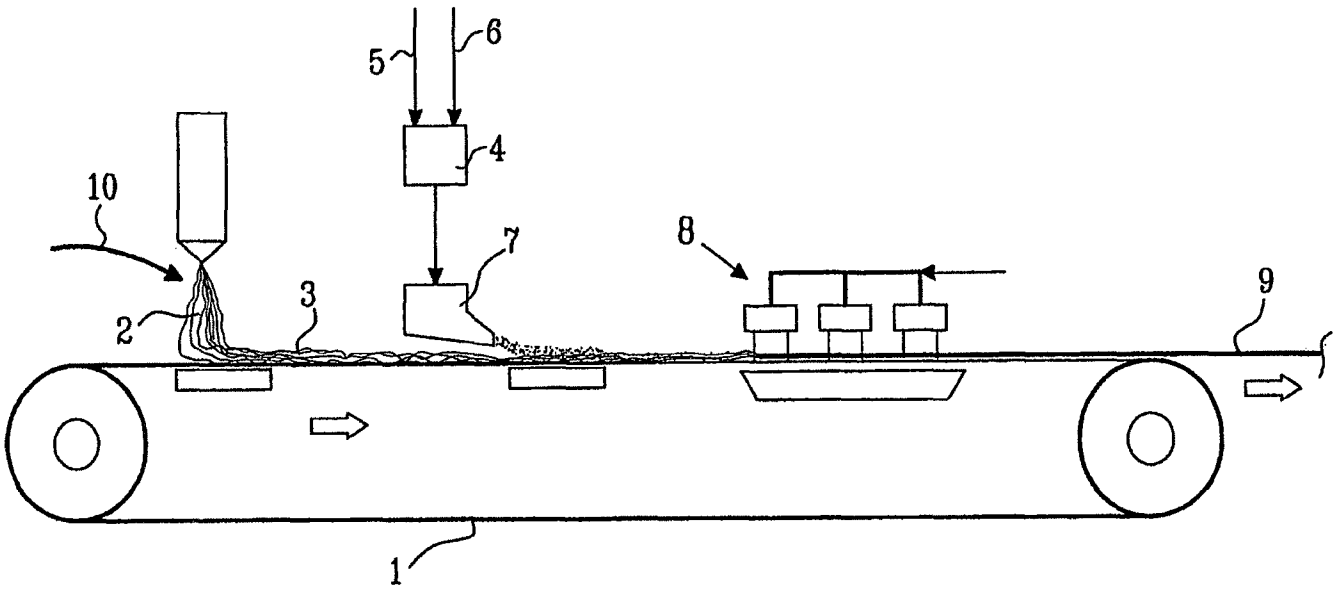
FIG. 1 shows schematically an exemplary embodiment of a device for producing a hydroentangled integrated composite nonwoven material according to the invention.
Figure 2A:
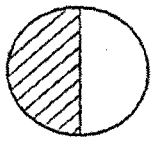
FIGS. 2A-2H show examples of cross sections for some splittable bicomponent fibres.
Figure 2B:
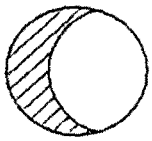
Figure 2C:
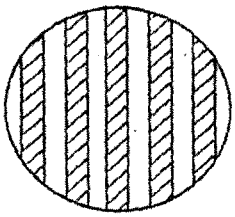
Figure 2D:
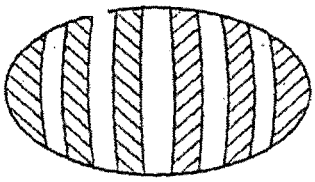
Figure 2E:
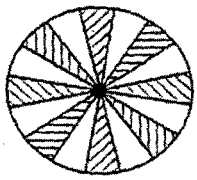
Figure 2F:
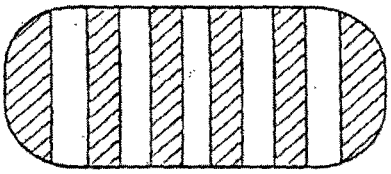
Figure 2G:
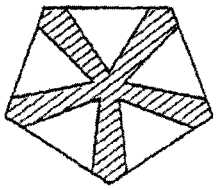
Figure 2H:
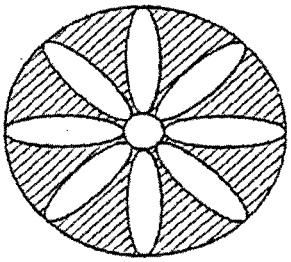

The hydroentangled integrated composite nonwoven material of the present invention comprises a mixture of continuous filaments and splittable shortcut staple fibres. Optionally, non-splittable staple fibres can be added. These different types of fibres are defined as follows.

Filaments

Filaments are fibres that in proportion to their diameter are very long, in principle endless. They can according to known technologies be produced by melting and extruding a thermoplastic polymer through fine nozzles, whereafter the polymer will be cooled, preferably by the action of an air flow blown at and along the polymer streams, and solidified into strands that can be treated by drawing, stretching or crimping. Chemicals for additional functions can be added to the surface.

Filaments can also according to known technologies be produced by chemical reaction of a solution of fibre-forming reactants entering a reagence medium, e.g. by spinning of viscose fibres from a cellulose xanthate solution into sulphuric acid.

Meltblown filaments are produced by extruding molten thermoplastic polymer through fine nozzles in very fine streams and directing converging hot air flows towards the polymers streams so that they are drawn out into continuous filaments with a very small diameter. Production of meltblown is e.g. described in U.S. Pat. No. 3,849,241 or 4,048,364. The filaments can be microfibres or macrofibres depending on their dimensions. Microfibres have a diameter of up to 20 μm, usually 2-12 μm. Macrofibres have a diameter of over 20 μm, usually 20-100 μm. Spunbond filaments are produced in a similar way, but the air flows are cooler and the stretching of the filaments is done by air to get an appropriate diameter. The filament diameter is usually above 10 μm, usually 10-100 μm. Production of spunbond is e.g. described in U.S. Pat. No. 4,813,864 or 5,545,371.

Spunbond and meltblown filaments are as a group called spunlaid filaments, meaning that they are directly, in situ, laid down on a moving surface to form a web, that further on in the process may be bonded. Controlling the MFR, melt flow rate, by choice of polymers and temperature profile is an essential part of controlling the extruding and thereby the filament formation. The spunbond filaments normally are much stronger and have a more even diameter than meltblown filaments.

Tow is another source of filaments, which normally is a precursor in the production of staple fibres, but also is sold and used as a product of its own. In the same way as with spunlaid filaments, fine polymer streams are drawn out and stretched, but instead of being laid down on a moving surface to form a web, they are kept in a bundle to finalize drawing and stretching. When staple fibres are produced, this bundle of filaments is then treated with spin finish chemicals, normally crimped and then fed into a cutting stage where a wheel with knives will cut the filaments into distinct fibre lengths that are packed into bales to be shipped and used as staple fibres. When tow is produced, the filament bundles are packed, with or without spin finish chemicals, into bales or boxes.

Any thermoplastic polymer, that has enough coherent properties to let itself be drawn out in this way in the molten state, can in principle be used for producing meltblown or spunbond filaments. Examples of useful polymers are polyolefines, such as polyethylene and polypropylene, polyamides, polyesters and polylactides. Copolymers of these polymers may of course also be used, as well as natural polymers with thermoplastic properties.

Staple Fibres

Staple fibres can be produced from the same substances and by the same processes as the filaments discussed above. Other staple fibres are those made from regenerated cellulose such as viscose and lyocell.

The staple fibres can be treated with spin finish and crimped, but this is not necessary for the type of processes preferably used to produce the material described in the present invention. Spin finish and crimp is normally added to ease and/or enable the handling of the fibres in a dry process, e.g. a card, and/or to give certain properties, e.g. hydrophilicity, to a material consisting only of these fibres, e.g. a nonwoven topsheet for a diaper.

The cutting of the fibre bundle normally is done to result in a single cut length, which can be altered by varying the distances between the knives of the cutting wheel. Depending on the planned use of the resulting end product different fibre lengths are used, between 25-50 mm for a thermobond nonwoven. For wetlaid hydroentangled nonwovens normally 12-18 mm, or down to 9 mm, are used.

Bicomponent Filaments and Fibres

A certain type of filament is the bicomponent variant. It is made by a meltspinning process where two synthetic melts of different polymers together form a strand by being coextruded through a nozzle and then cooled and stretched as for ordinary filaments. (One exemplary process is described in U.S. Pat. No. 5,759,926.) The different polymers will then under the proper conditions not be homogeneously blended but the first and second polymers will be arranged at distinct segments across the cross-section of the filament, normally along the whole length of the filament. A lot of different polymers can be used to make bicomponent filaments; polyethylene and polypropylene, polypropylene and polyester, polypropylene and polyamide, polyethylene and polyester, polyamide and polyester. The mixture often approaches 50% of each by weight, but other compositions are used, depending on the configuration and number of the segments.

The shape of the bicomponent fibres normally is round, but many other shapes are used, such as trilobal, oval, rectangular, etc.

The different polymer segments can have many different shapes. Common variants are half-half, crescent, banded, pie, star, petals, etc. See FIG. 2.

The segments preferably should be formed continuously along the total length of the filaments.

Forming bicomponent staple fibres is analogous to forming staple fibres from monocomponent filaments. The filaments are fed into a cutting stage where a wheel with knives will cut the filaments into distinct fibre lengths that are packed into bales to be shipped. Care should normally be taken not to split the fibres already at cutting. Depending on the planned use of the resulting end product different fibre lengths are used, between 25-50 mm for a thermobond nonwoven. For wetlaid hydroentangled nonwovens normally 12-18 mm, or down to 9 mm, are used.

The description above about bicomponent filaments and fibres can even be expanded to three- or higher multicomponent filaments, see FIG. 2, to reach further demands for softness, strength, water/chemical affinities, thermobondability etc.

Splittable Filaments and Fibres

The different polymers in a standard bicomponent (or multicomponent) filament or fibre should normally have a certain affinity to each other to make the bicomponent filament or fibre have the required stability; the components should not separate into segments when processed or used in the final product.

But, for so-called splittable bicomponent filaments or fibres, whose components indeed should separate, the affinity between the different polymers must be controlled carefully such that the polymers will hold together during one part of the final product-forming process, and then separate to the wanted degree in the latter part of the final product-forming process. The affinity is adjusted by choosing polymers of suitable chemical type, with suitable molecular weights, or with suitable physical properties, or by addition of chemicals to the polymer melts that will affect the surface properties of the polymers.

The fibres could be split by a number of different methods as heat-treatment by hot air, water or steam, as chemical disintegration of the boundary surface by chemical leaching or plasma treatment, as mechanical stressing by physical drawing or bending, by water jet impingement, i.e. hydroentangling. This can be done at fibre production, at web preparation, at web consolidation, at web drying, or at a web post treatment process step.

The splitting of a fibre will normally proceed stepwise, with one internal surface between the segments breaking up at a time, ie if the splittable fibre consists of more than two segments many variants of partly split fibres will coexist. As a rest part of a partly split fibre gets thinner and thinner, it can often get more and more difficult to continue the splitting, as the rest fibre will be so soft that even a large, sudden force (like hydroentangling water jet streams) only will make it bend away and not be split. Thus, some of the segments may never break apart into separate segments.

One advantage of using splittable fibres that are split in the later stages of the web production process is that during the earlier stages of the process fewer fibres will have to be handled; and they will also be of a larger diameter, which greatly reduces the mechanical/process load. Especially for a card this is a great advantage as a card handles each fibre separately.

After splitting there will be finer fibre segments, and many more of them, in the final product, thus making it possible to enhance the chosen product characteristics.

Non-Splittable Filaments and Fibres

As stated above, normally the different polymers in a standard bicomponent (or multicomponent) filament or fibre have a certain affinity to each other to make the bicomponent filament have a required stability; the components should not separate into segments when processed or used in the final product. This is commonly used when different melting temperatures for the different components are utilised in thermobonding, where the lower-melting component is more or less melted in a hot press nip, while the higher-melting component still has its full integrity.

All types of filaments or fibres with only one component are likewise non-splittable.

Process

One general example of a method for producing the material according to an embodiment of the present invention is shown in FIG. 1. FIG. 1 also includes the addition of optional non-splittable shortcut staple fibres 6, but this is only for clarification and not a necessary part of the invention.

A preferred embodiment according to the invention shown in FIG. 1 comprises the steps of: providing an endless forming fabric 1, where continuous filaments 2 can be laid down, and excess air be sucked off through the forming fabric, to form a randomized unbonded web structure 3;

providing a slurry preparation stage 4, where dry splittable shortcut staple fibres 5 are dispersed in water with optional addition of chemicals;

advancing the forming fabric 1 with the unbonded web 3 to a wetlaying stage 7, where a slurry comprising a mixture of splittable shortcut staple fibres 5, some of them split into segments from the treatment in the slurry preparation stage 4, is wetlaid on and partly into the unbonded web 3 of continuous filaments, and excess water is drained off through the forming fabric;

advancing the forming fabric 1 with the filaments and fibres/segments mixture to a hydroentangling stage 8, where the filaments, fibres and segments are mixed intimately together and bonded into a nonwoven web 9, while at the same time most hitherto unsplit splittable fibres are split, by the action of many thin jets of high-pressure water impinging on the fibres and filaments to split, mix and entangle them with each other, and entangling water is drained off through the forming fabric;

advancing the forming fabric 1 with the still wet nonwoven web 9 to a drying stage (not shown) where the nonwoven web is dried, thus forming a nonwoven material;

and further advancing the nonwoven material to stages for rolling, cutting, packing, etc.

An alternative embodiment according to the invention shown in FIG. 1 comprises the steps of:

providing an endless forming fabric 1, where continuous filaments 2 can be laid down, and excess air be sucked off through the forming fabric, to form a randomized unbonded web structure 3;

providing a slurry preparation stage 4, where dry splittable shortcut staple fibres 5 and non-splittable shortcut staple fibres 6 are dispersed in water with optional addition of chemicals; advancing the forming fabric 1 with the unbonded web 3 to a wetlaying stage 7, where a slurry comprising a mixture of splittable shortcut staple fibres 5, some of them split into segments from the treatment in the slurry preparation stage 4, and non-splittable shortcut staple fibres 6 is wetlaid on and partly into the unbonded web 3 of continuous filaments, and excess water is drained off through the forming fabric;

advancing the forming fabric 1 with the filaments and fibres/segments mixture to a hydroentangling stage 8, where the filaments, fibres and segments are mixed intimately together and bonded into a nonwoven web 9, while at the same time most hitherto unsplit splittable fibres are split, by the action of many thin jets of high-pressure water impinging on the fibres and filaments to split, mix and entangle them with each other, and entangling water is drained off through the forming fabric;

advancing the forming fabric 1 with the still wet nonwoven web 9 to a drying stage (not shown) where the nonwoven web is dried, thus forming a nonwoven material;

and further advancing the nonwoven web to stages for rolling, cutting, packing, etc.

The balance between how much of the splitting is done in the slurry preparation stage and how much is done in the hydroentangling stage can be controlled by choosing the desired type of splittable fibres and the actual process conditions. It is possible to let a major proportion of the splitting be done in the slurry preparation stage, by using easy-split fibres, as this will give an exceedingly well mixed final nonwoven web. This would however put increased process demands on the wetlaying stage, so it is more preferred to let the major part of the splitting be done in the hydroentangling stage. It might even be preferred to have no or only a very minor part of the splitting take place in the slurry preparation stage.

Under certain conditions, depending on fibre length and thickness and the fibre concentration in the slurry, the fibres can be so pliable and in such close contact with each other that they tangle themselves in the slurry to get roping, i.e. become tangled into knots, flocs and twirls in the slurry. This could cause problems in the wetlaying headbox, so this can be a delimiting factor for how much of the splitting that can be done in the slurry preparation stage.

Filament Web

According to the embodiment shown in FIG. 1, continuous filaments 2 made from extruded molten thermoplastic pellets are laid down directly on a forming fabric 1. There they are allowed to form an unbonded web structure 3 in which the filaments can move relatively freely from each other. This is achieved preferably by making the distance between the nozzles and the forming fabric 1 relatively large, so that the filaments are allowed to cool down before they land on the forming fabric, at which lower temperature their stickiness is largely reduced. Alternatively cooling of the filaments before they are laid down on the forming fabric can be achieved in some other way, e.g. by means of using multiple air sources where air 10 is used to cool the filaments when they have been drawn out or stretched to the preferred degree.

The air used for cooling, drawing and stretching the filaments 2 is sucked through the forming fabric 1, to let the filaments follow the air flow into the meshes of the forming fabric to be stayed there. A good vacuum might be needed to suck off the air.

The speed of the filaments as they are laid down on the forming fabric is much higher than the speed of the forming fabric, so the filaments will form irregular loops and bends as they are collected on the forming fabric to form a very randomized unbonded web structure.

The basis weight of the filaments of the formed unbonded web structure 3 should preferably be between 10 and 60 $g/m^2$.

Wet-Laying

The splittable shortcut staple fibres 5 and optional non-splittable staple fibres 6 are dispersed in conventional way, either mixed together or first separately dispersed and then mixed, and conventional papermaking additives such as wet and/or dry strength agents, retention aids, dispersing agents, are added, to produce a well mixed dispersion of splittable shortcut staple fibres 5 and optional non-splittable staple fibres 6 in water.

During the dispersion in water of the staple fibres, a proportion of the splittable fibres will be split by the agitation and kneading effect. This proportion can range from insignificant to almost total; especially if a high proportion of already split fibres is advantageous for the further processing, pulp kneading apparatus can be included in the disperser.

This mixture is pumped out through a headbox of a wet-laying stage 4 onto the moving forming fabric 1 where it is laid down on the unbonded web structure 3 with its freely moving filaments 2.

The splittable shortcut staple fibres 5, fibre segments from these and the optional non-splittable staple fibres 6 will stay on the forming fabric and the filaments of the unbonded web structure 3. Some of the fibres and segments will enter between the filaments, but the vast majority of them will stay on top of the filaments of the unbonded web structure.

The excess water is sucked through the unbonded web of filaments laid on the forming fabric and down through the forming fabric, by means of suction boxes arranged under the forming fabric.

Wet-laying in our opinion gives a great advantage for splittable fibres, with no need for crimped fibres as is a must in a carded process. Crimping would put a large stress on the splittable fibres, possibly making them split into their segments too early in the web production process, or force the use of strong affinity between the segments, which would make them very hard to break apart and demand a large energy input to split them after web formation.

Carding such thin segments or partly split fibres would not be easy. A mixture of thinner and coarser fibres has a tendency to form twirls and knots and block the clothing of the card.

Another advantage of the wet-laying process, which enables the use of straight, uncrimped, fibres, is the enhanced mixing of these straight fibres into the filament web. The straight fibres, without nicks etc. from crimping, can much easier be forced deeper into the web that is built from filaments, splittable fibres, partly split fibres, fibre segments, and optional non-splittable staple fibres. Thus, the resulting material can be less pronounced two-sided, with less spending of hydroentangling energy.

Entangling

The fibrous web of continuous filaments 2 and already split and still unsplit splittable shortcut staple fibres 5 and optional non-splittable shortcut staple fibres 6 are hydroentangled while they are still supported by the forming fabric 1 and are intensely mixed and bonded into an integrated composite nonwoven web 9. An instructive description of the hydroentangling process is given in CA patent no. 841 938.

In the hydroentangling stage 8 the different fibre types will be entangled and a composite nonwoven web 9 is obtained in which all fibre types are substantially homogeneously mixed and integrated with each other. The fine mobile spunlaid filaments are twisted around and entangled with themselves and the other fibres and fibre segments which gives a material with very high strength. The energy supply at the hydroentangling is appropriately in the interval 200-700 kWh/ton.

Preferably, no bonding, by e.g. thermal bonding or hydroentangling, of the filaments of the unbonded web structure 3 should occur before the splittable shortcut staple fibres 5, segments from these and non-splittable shortcut staple fibres 6 are laid down in the wet-laying stage 7. The filaments should preferably be completely free to move in respect of each other to enable the various staple fibres and segments to mix and twirl into the filament web during entangling. Thermal bonding points between filaments in the filament web at this part of the process would act as blockings to stop the various staple fibres and segments from enmeshing near these bonding points, as they would keep the filaments immobile in the vicinity of the thermal bonding points. The sieve effect of the web would be enhanced and a more two-sided final material would be the result. By no thermal bondings is meant that there are substantially no points where the filaments have been excerted to heat and pressure, e.g. between heated rollers, to render some of the filaments pressed together such that they will be softened and/or melted together to deformation in points of contact. Some bond points could especially for meltblown result from residual tackiness at the moment of laying-down, but these will be without deformation in the points of contact, and would probably be so weak as to break up under the influence of the force from the hydroentangling water jets.

Even if it is much preferred that the filament web is not bonded before the wetlaying of the staple fibres and segments, the inventive method to some degree is capable of rendering a nonwoven material with the appreciated characteristics of the invention, even if the filament web has been lightly prebonded, by thermobonding or by hydroentangling. Some of the thermobonding points will be broken by the hydroentangling and some of them will still be left in the final nonwoven material. In this case more energy will be needed in the final hydroentangling and still it is difficult to reach the same level of mixing throughout the thickness of the nonwoven material, to avoid two-sidedness. The fibres used should be at the lower end of the length span, and most of the splitting should be done before the wetlaying stage, to have more easily mixed fibre segments.

The splittable shortcut staple fibres 5 will, if they have not done so before, to a high degree be split into their segments by the intense energy of the water jets. As the fibres are short, they will easily and preferably be split along their total length into very thin fibre segments. These are in many of the different forms of splittable fibres flat bands or thin wedges; the banded variants are preferred (see FIG. 2). Such thin bands have a low bending modulus and are very pliable and can easily be mixed and entangled deep into the filament web, very often with one end sticking out from the surface. These segment ends sticking out from the surface is a much appreciated consequence of the present application, as this will add a high degree of textile softness to the finished nonwoven material.

These fibres should preferably be very short, to make it easy to accomplish this effect. 3-7 mm has proven very suitable, as they easily split along their entire length. Also fibres up to 10 mm have shown good tendency to split along the entire length. Fibres up to 16 mm can be used, but then not too much splitting can be allowed in the dispersion of the fibres, but should be done in the hydroentangling.

Splittable shortcut staple fibres with many segments are highly preferred as these result in very many fibre ends that can be sticking out from the surface of the nonwoven material. The number of segments should preferably be at least five. Also a shorter fibre will result in more fibre ends for a given fibre mix and basis weight than a longer one.

The entangling stage 8 can include several transverse bars with a plurality of rows of nozzles from which very fine water jets under very high pressure are directed against the fibrous web to provide entangling of the fibres. The water jet pressure can also be adapted to have a certain pressure profile with different pressures in the different rows of nozzles. Normally a rising pressure profile is used, with the lowest pressure in the first row and the highest pressure in the final row.

Alternatively, the fibrous web can before hydroentangling be transferred to a second entangling fabric. In this case the web can also prior to the transfer be hydroentangled by a first hydroentangling station with one or more bars with rows of nozzles.

Drying Etc.

The hydroentangled wet nonwoven web 9 is then dried, which can be done on conventional web drying equipment, preferably of the types used for tissue drying, such as through-air drying or Yankee drying. The nonwoven material is after drying normally wound into mother rolls before converting.

The nonwoven material is then converted in known ways to suitable formats and packed. The structure of the nonwoven material can be changed by further processing such as microcreping, hot calandering, embossing, etc. To the nonwoven material can also be added different additives such as wet strength agents, binder chemicals, latexes, debonders, etc.

Nonwoven Material

A composite nonwoven material according to an embodiment of the invention can be produced with a total basis weight of preferably 20-120 g/m$^2$, more preferably 50-80 g/m$^2$.

When the filaments are unbonded this will improve the mixing-in of the staple fibres and/or fibre segments, at the wet-laying and in the first phase of the hydroentangling, because of the open structure of the unbonded web, such that even a short fibre and/or segment will have enough entangled bonding points to keep it securely in the web.

When the fibres and/or filaments are held more securely in the web, the splitting is much improved, as they cannot move or bend away when the water jets hits them, but will be split into more and more singular segments, instead of bunches of segments. Also, when short fibres are used, they will easily be split along their total length, so the segments will be free to move along their total length.

The shorter staple fibres and/or segments will then result in an improved material as they have more fibre ends per gram fibre and are easier to move in the Z-direction (perpendicular to the web plane). It can during the hydroentangling easily happen with such a short fibre or fibre segment that it rests against only one other filament or fibre, and then when it is hit by a water jet on one end it will swing the other end up in the Z-direction. Many more fibre ends will project from the surface of the web, thus enhancing the textile feeling.

The secure bonding will result in very good resistance to abrasion. The splitted fibres will greatly enhance the available surface of the nonwoven for adsorption of particles like dust. A great advantage with the nonwoven material of the present invention with easily split fibres is that these good properties are there already when a customer starts to use the material; the material does not have to be broken in and washed to achieve its best adsorptive properties like for a material with more hard-to-split fibres.

The filaments (and fibres) are typically coarser (1-4 dtex) than the fibre segments (0.1-0.5 dtex). The mixture of these will render a resultant web with a higher bulk and a more varied pore structure than for a single fibre web, see FIG. 3. This adds a great advantage to the material due to the high absorption capacity created by both the high bulk and the dirt-entrainment capacity created by the varied pore structure.

For hydroentangled nonwoven materials made by traditional wetlaid technology with only staple fibres and pulp, the strength of the material and its properties like surface abrasion resistance are increased as a function of the fibre length (for the same thickness and polymer of the fibre), and thus entangling points for each fibre.

As can be seen from the examples the staple fibres can be a mixture of fibres based on different polymers, with different lengths and diameters. They can also have different colours, to be able to indicate to the end-user what type of material it is, and its indicated use in e.g. a series of similar materials for varied end uses where a certain colour indicates a certain type of use. It is preferred to colour some of the non-splittable staple fibres completely by immersion or any other suitable procedure, but it is also conceived to e.g. print bands or a pattern on a fibrous mat of staple fibres, to colour a part of the length of at least some of the non-splittable staple fibres.

It is also contemplated to add a certain proportion of non-splittable staple fibres longer than 7 mm and even longer than 12 mm to the composite nonwoven. This certain proportion could be up to 10% of the amount of staple fibres shorter than 7 mm, based on weight proportions. No specific advantages are however seen by this addition. It will predominantly add to the strength of the nonwoven, but the strength is more easily adjusted by the amount of filaments.

Figure 3:
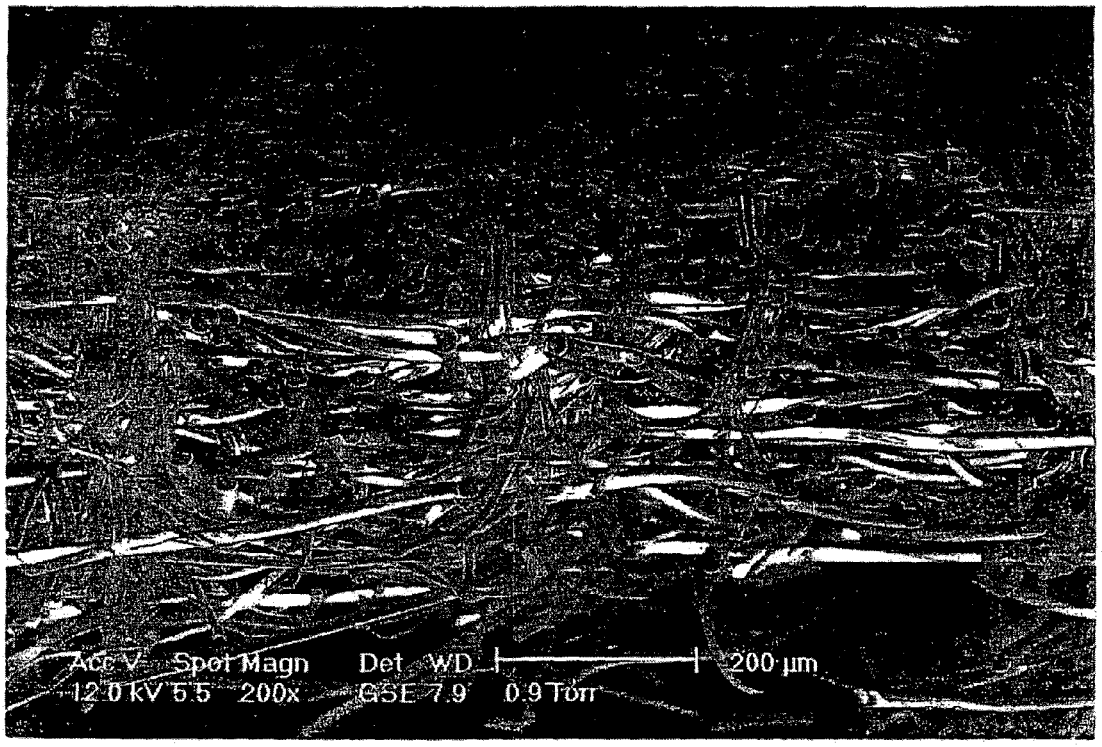
FIG. 3 shows a micro-photograph of an enlarged side view of a material according to an embodiment of the invention with a mixture of spunlaid filaments and splittable fibres.

As can be seen in the micro-photograph in FIG. 3, which is taken from Example 1, the thin fibre segments very easily have followed the water jets into and through the unbonded web of thicker filaments. This alignment in the Z-direction is very advantageous and results in some of the good properties of the inventive material.

Due to the high ability to split for the short fibres a major part of them will be split in a nonwoven material produced according to the invention. Thus the material is ready for use directly after the drying, no post-treatment to augment the split degree is needed. With major part we mean that most of the splittable fibres are split at least once into segments, which can then later be further split.

It is foreseen to add a suitable amount of an antistatic agent to the nonwoven material, especially when the nonwoven is aimed for dry wiping uses in certain environments, e.g. electronic appliances. The antistatic agent could e.g. be chosen from the group of anionic phosphate esters, cationic amine derivatives, and amphoteric fatty alcohol derivatives.

The invention is of course not limited to the embodiments shown in the drawings and described above and in the examples but can be further modified within the scope of the claims.

EXAMPLES

A number of hydroentangled materials according to embodiments of the invention with different filament and fibre compositions were produced and tested with respect to interesting parameters. The total basis weight of the hydroentangled materials was around 80 g/m$^2$. Test results from the examples and from reference materials are shown in Table 1.

The method for determining the drapability is based on Edana method 'Bending length', 50.5-99. A rectangular strip of fabric is supported on a horizontal platform with the long axis of the strip parallel to the long axis of the platform. The strip is advanced in the direction of its length so that an increasing part overhangs and bends down under its own weight. The overhang is free at one end and fixed at the other due to the pressure applied by a slide on the part of the test piece still on the platform. When the leading edge of the test piece has reached a plane passing through the edge of the platform and inclined at an angle of 41.5° below the horizontal, the overhanging length is measured.

The overhanging length is reported as drapability, thus a lower value indicates a material that easier bends and conforms to an underlying surface.

Example 1

A 0.4 m wide web of spunlaid filaments was laid down onto a forming fabric at 20 m/min such that the filaments were not bonded to each other. The unbonded web of spunlaid filaments was slightly compacted and transferred to a second forming fabric for addition of the wet-laid components. By a 0.4 m wide headbox a fibre dispersion containing staple fibres and split fibre segments was laid onto the unbonded web of spunlaid filaments and the excess water was drained and sucked off.

The unbonded spunlaid filaments and wetlaid fibres and fibre segments were then mixed, some of the remaining splittable fibres were split, and the filaments, fibres and fibre segments were bonded together by hydroentanglement with three manifolds at a pressure of 7.0 to 8.0 MPa. The hydroentanglement was done from the side of the web where the wetlaid fibres were laid down and the staple fibres and segments were thus moved into and intensively mixed with the spunlaid filament web. The energy supplied at the hydroentanglement was about 450 kWh/ton.

Finally the hydroentangled material was dewatered and then dried using a through-air drum drier.

The composition of the composite material was 50% spunlaid polypropylene filaments and 50% splittable short-cut bicomponent (polyester and polyamide) staple fibres (from Kuraray). The titre of the spunlaid filaments was measured by a scanning electron microscope and found to be 2.7 dtex. The bicomponent fibres were of the banded type with I I bands and a titre of 3.3 dtex before splitting and 0.3 dtex after splitting. The length of the bicomponent fibres was 5 mm.

Example 2

Using the same process as in Example 1, another test was made. The same splittable bicomponent fibre was used, and the titre of the spunlaid filaments was measured to 2.8 dtex. Mixing composition was 50% filaments and 50% splittable fibres. Running speed was 12 m/min, manifold pressure 8.0 MPa and supplied energy about 600 kWh/ton.

Example 3

Using the same process as in Example 1, still another test was made. The same splittable bicomponent fibre was used, and the titre of the spunlaid filaments was measured to 2.8 dtex. Mixing composition was 50% filaments, 25% splittable fibres and 25% polyester staple fibres (from Kuraray) with a length of 12 mm and a titre of 0.5 dtex. Running speed was 12 m/min, manifold pressure 8.0 MPa and supplied energy about 600 kWh/ton.

Example 4

Using the same set-up as in Example 3, still another test was made. The same splittable bicomponent fibre was used, and the titre of the spunlaid filaments was measured to 2.1 dtex. Mixing composition was 33% filaments, 33% splittable fibres and 33% polyester staple fibres with a length of 12 mm and a titre of 0.5 dtex. Running speed was 12 m/min, manifold pressure 8.0 MPa and supplied energy about 600 kWh/ton.

Example 5

Using the same set-up as in Example 3, a test with addition of a cellulosic fibre was made. The same splittable bicomponent fibre was used, and the titre of the spunlaid filaments was measured to 2.1 dtex. Mixing composition was 33% filaments, 17% splittable fibres and 50% lyocell staple fibres (from Accordis) with a length of 5 mm and a titre of 1.7 dtex. Running speed was 15 m/min, manifold pressure 8.0 MPa and supplied energy 550 kWh/ton.

REFERENCE 1

A reference material was produced as in Example 5, but with fluff pulp instead of splittable staple fibres. Thus the mixture was 33% filaments, 17% fluff pulp and 50% lyocell fibres.

REFERENCE 2

A commercial nonwoven material (Tork Strong from SCA Hygiene Products AB) with 60% fluff pulp, 20% polypropylene staple fibres with 19 mm length and 1.7 dtex, 20% polyester staple fibres with 20 mm length and 1.7 dtex was used as reference No. 2. The material is wetlaid and rather lightly embossed not to flush out too much of the fluff pulp.

Results:

Test values from the Examples and References are shown in Table 1.

From the Examples it can be seen that a very strong and durable material is obtained. Both dry and wet strength values and elongation values are improved. Thus, also work to rupture values show that the material is very durable.

The drapability and textile feeling have been improved. The surface structure of Example 1 (and all other Examples without pulp) results in a material that has a smooth surface and is softer to the touch and has better drapability than pulp-containing materials. The inventive material is highly favoured by an internal test panel for its softness and smoothness.

In FIG. 3 can be seen how a material according to the invention has both thicker filaments and thinner split segments, that cooperates to form a pore structure with a variation that is beneficial when the product is used to e.g. wipe dust from a computer or TV screen, or from a mirror, or clean eye glasses, or wipe pen markings from a whiteboard. Practical tests have shown good success in such use applications.

Example 5 shows how a material according to the invention with the addition of cellulosic fibres will get lower strength values, but they are still good, and such a material is very well suited for particle adsorption in the presence of hydrophilic liquids, and can be used as an effective wet wiper.

TABLE 1

| Example, Reference | | Ex. 1 | Ex. 2 | Ex. 3 | Ex. 4 | Ex. 5 | Ref. 1 | Ref. 2 |
|---|---|---|---|---|---|---|---|---|
| Mixture: | spunlaid | 50% | 50% | 50% | 33% | 33% | 33% | |
| | splittable | 50% | 50% | 25% | 33% | 17% | | |
| | standard staple | | | 25 % | 33% | | | 40% |
| | Lyocell | | | | | 50% | 50% | |
| | fluff pulp | | | | | | 17% | 60% |
| Basis weight (g/m$^2$) | | 75 | 84 | 82 | 78 | 82 | 85 | 83 |
| Thickness 2 kPa (um) | | 418 | 434 | 500 | 490 | 485 | 542 | 357 |
| Bulk 2 kPa (cm$^3$/g) | | 5.6 | 5.1 | 6.1 | 6.3 | 5.9 | 6.4 | 4.3 |
| Entangling energy (kWh) | | 450 | 600 | 600 | 600 | 550 | 550 | 200 |
| Tensile strength dry MD (N/m) | | 5183 | 5395 | 4634 | 4600 | 3031 | 3158 | 1499 |
| Tensile strength dry CD (N/m) | | 2447 | 2927 | 2966 | 2962 | 2057 | 2004 | 630 |
| Elongation MD (%) | | 62 | 61 | 55 | 49 | 72 | 58 | 13 |
| Elongation CD (%) | | 123 | 107 | 113 | 91 | 102 | 89 | 44 |
| Work to rupture MD (J/m$^2$) | | 2174 | 2095 | 1766 | 1337 | 1480 | 1287 | 251 |
| Work to rupture CD (J/m$^2$) | | 1752 | 1894 | 1948 | 1487 | 1205 | 997 | 261 |
| Tensile strength MD, wet (N/m) | | 4535 | 5211 | 4971 | 5037 | 3570 | 3143 | 568 |
| Tensile strength CD, wet (N/m) | | 2508 | 3099 | 2945 | 2888 | 2311 | 1748 | 185 |
| Drapability MD, mm | | 90 | 92 | 80 | 93 | 89 | 113 | 103 |
| Drapability CD, mm | | 47 | 48 | 57 | 48 | 58 | 85 | 62 |

We claim:

1. A method of producing a hydroentangled integrated composite nonwoven material, comprising forming a web of randomized continuous filaments on a forming fabric;

providing an aqueous fibre dispersion comprising splittable shortcut staple fibres having a length of 3 to 16 mm;

wetlaying the aqueous fibre dispersion on the web of continuous filaments;

thus forming a fibrous web comprising the continuous filaments and splittable shortcut staple fibres; and subsequently hydroentangling the fibrous web to form a hydroentangled nonwoven material, wherein a numerical majority of the splittable fibres are split during the hydroentanglement step.

2. The method according to claim 1, wherein no thermal bonding process step is applied to the web of continuous filaments.

3. The method according to claim 1, wherein the splittable shortcut staple fibres have a length of 3 to 10 mm.

4. The method according to claim 1, wherein the splittable shortcut staple fibres have a length of 3 to 7 mm.

5. The method according to claim 1, wherein the aqueous fibre dispersion and thus the fibrous web further comprises non-splittable staple fibres.

6. The method according to claim 5, wherein the non-splittable staple fibres are selected from the group consisting of polyethylene, polypropylene, polyesters, polyamides, polylactides, rayon, and lyocell fibres and/or from the group consisting of polyethylene-polypropylene, polypropylene-polyester, polypropylene-polyamides bicomponent fibres without ability to split.

7. The method according to claim 1, wherein the fibrous web comprises 15-75% continuous filaments and 25-85% splittable shortcut staple fibres, all percentages calculated by weight of the fibrous web.

8. The method according to claim 5, wherein the fibrous web comprises 15-75% continuous filaments, 10-60% splittable shortcut staple fibres, and 1-75% non-splittable staple fibres, all percentages calculated by weight of the fibrous web.

9. The method according to claim 1, wherein the continuous filaments are spunlaid filaments.

10. The method according to claim 1, wherein the continuous filaments are spunbond filaments.

11. The method according to claim 1, wherein the continuous filaments are selected from the group consisting of polypropylene, polyester, and polylactide filaments.

12. The method according to claim 1, wherein the splittable shortcut staple fibres are selected from the group consisting of polyethylene-polypropylene, polypropylene-polyester, polypropylene-polyamide bicomponent fibres with ability to split.

13. The method according to claim 1, wherein the splittable shortcut staple fibres are selected from the group consisting of banded, crescent, star or pie types of bicomponent fibres.

* * * * *